US007201522B2

(12) United States Patent
Bandholz et al.

(10) Patent No.: US 7,201,522 B2
(45) Date of Patent: Apr. 10, 2007

(54) PRINTER CARTRIDGE

(75) Inventors: Brent A. Bandholz, West Allis, WI (US); Richard L. Carriere, Oak Creek, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 110 days.

(21) Appl. No.: 11/020,333

(22) Filed: Dec. 22, 2004

(65) Prior Publication Data

US 2005/0152732 A1 Jul. 14, 2005

Related U.S. Application Data

(63) Continuation-in-part of application No. 10/639,573, filed on Aug. 12, 2003, now Pat. No. 6,910,819.

(51) Int. Cl.
*B41J 32/00* (2006.01)
*B41J 35/28* (2006.01)
*B41J 33/14* (2006.01)

(52) U.S. Cl. ..... 400/578; 400/613; 400/616; 400/623; 248/578.2

(58) Field of Classification Search ..... 400/578, 400/613, 616, 623; 242/578.2
See application file for complete search history.

(56) References Cited

U.S. PATENT DOCUMENTS

| | | | |
|---|---|---|---|
| 3,926,110 | A | 12/1975 | Hubbard et al. |
| 4,050,375 | A | 9/1977 | Orlens |
| 4,264,396 | A | 4/1981 | Stewart |
| 4,385,958 | A | 5/1983 | Long |
| 4,440,514 | A | 4/1984 | Keiter et al. |
| 4,498,947 | A | 2/1985 | Hamisch, Jr. et al. |
| 4,678,353 | A | 7/1987 | Richardson et al. |
| 4,724,033 | A | 2/1988 | Vanderpool et al. |
| 4,930,913 | A | 6/1990 | Basile |
| 4,990,007 | A | 2/1991 | Schmidt et al. |
| 5,078,523 | A | 1/1992 | McGourty et al. |
| 5,111,216 | A | 5/1992 | Richardson et al. |
| 5,127,750 | A | 7/1992 | Burgin |
| 5,135,319 | A | 8/1992 | Kobayashi et al. |
| 5,259,679 | A | 11/1993 | Hwang |
| 5,348,406 | A | 9/1994 | Yoshiaki et al. |
| 5,364,042 | A | 11/1994 | Wyman |
| 5,478,159 | A | 12/1995 | Schneider et al. |
| 5,497,701 | A | 3/1996 | Uland |
| 5,501,536 | A | 3/1996 | Kleve |

(Continued)

*Primary Examiner*—Daniel J. Colilla
*Assistant Examiner*—Marvin P. Crenshaw
(74) *Attorney, Agent, or Firm*—Quarles & Brady LLP

(57) ABSTRACT

A printer cartridge suitable for use in a cartridge-based printer houses and dispenses a roll of label media, and includes a housing having a top wall and a bottom wall. A yoke pivotally mounted between the top and bottom walls for pivotable movement about a pivot axis includes a label media supply shaft for holding a roll of label media. The label media supply shaft has a longitudinal axis spaced from, and parallel to, the pivot axis. A label media drive roller is rotatably mounted between the top and bottom walls, and a biasing means biases the yoke toward the label media drive roller to maintain the roll of label media in contact with the label media drive roller. Ratchet teeth fixed relative to at least one of the housing and yoke engage structure of the other of the housing and the yoke to prevent the yoke from pivoting away from the label media drive roller.

15 Claims, 9 Drawing Sheets

U.S. PATENT DOCUMENTS

| | | | |
|---|---|---|---|
| 5,658,647 | A | 8/1997 | Magill et al. |
| 5,771,803 | A | 6/1998 | Takami |
| 5,820,277 | A | 10/1998 | Schulte |
| 6,113,293 | A | 9/2000 | Schanke et al. |
| 6,130,699 | A | 10/2000 | Christensen et al. |
| 6,142,686 | A | 11/2000 | Schanke et al. |
| 6,266,075 | B1 | 7/2001 | Feitel et al. |
| 6,390,694 | B1 | 5/2002 | Allen et al. |
| 6,428,225 | B1 | 8/2002 | Nguyen et al. |
| 6,454,476 | B1 | 9/2002 | Negatu et al. |
| 6,511,238 | B1 * | 1/2003 | Glize ..... 400/234 |
| 6,520,696 | B2 | 2/2003 | Huss et al. |
| 6,565,273 | B2 | 5/2003 | Yamada |
| 6,732,619 | B2 | 5/2004 | Carriere et al. |
| 2002/0094221 | A1 | 7/2002 | Sunada et al. |
| 2003/0001334 | A1 | 1/2003 | Hoberock |
| 2003/0071159 | A1 | 4/2003 | Hiraguchi et al. |

* cited by examiner

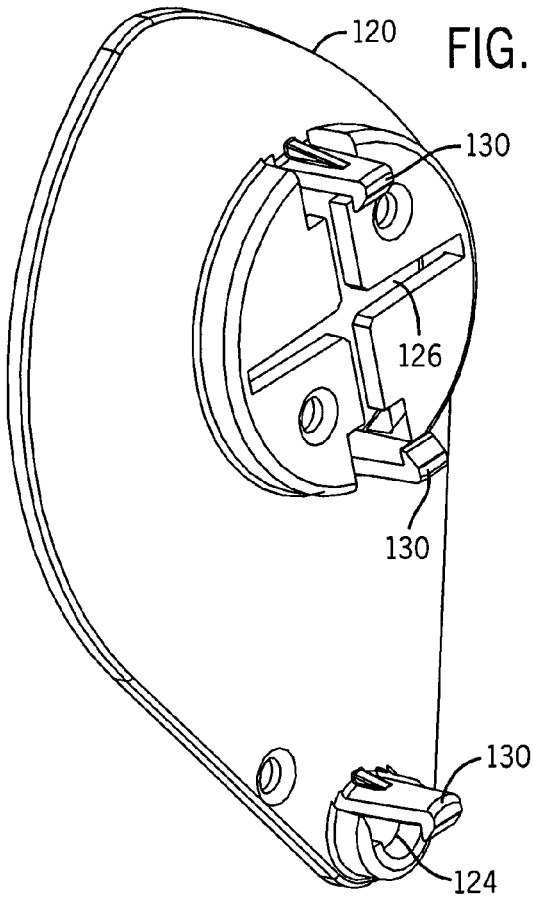
FIG. 12
FIG. 13
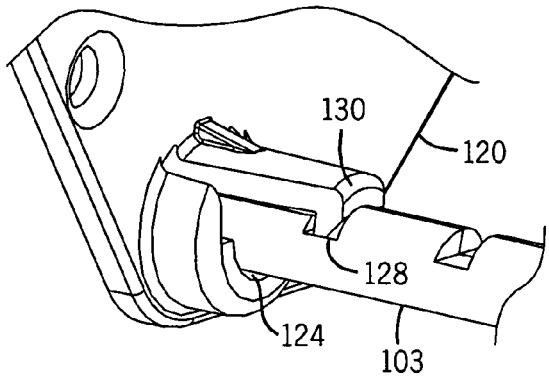
FIG. 14
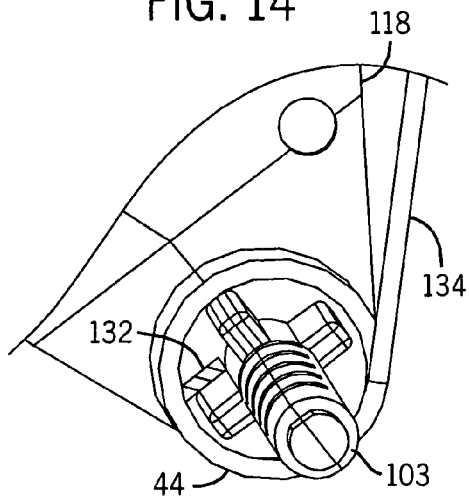

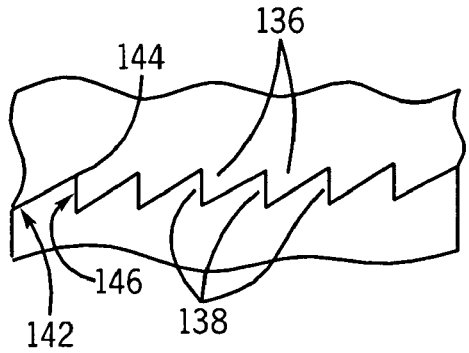
FIG. 15
FIG. 16
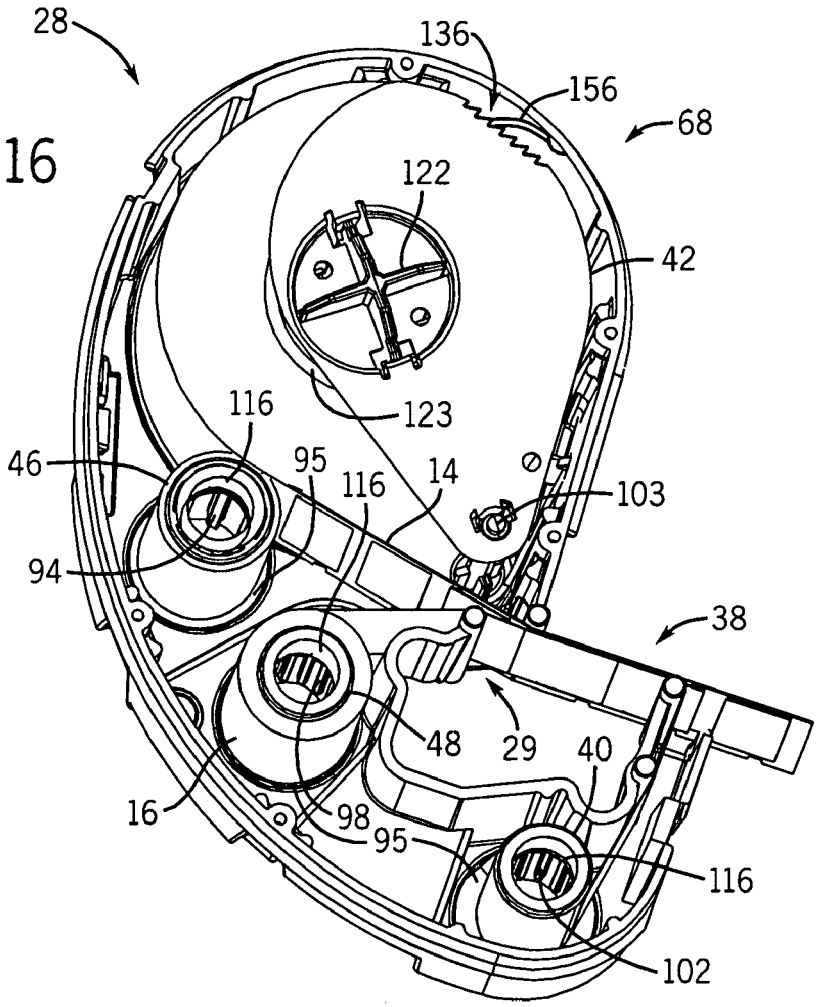

PRINTER CARTRIDGE

CROSS REFERENCES TO RELATED APPLICATIONS

This application is a continuation-in-part of U.S. patent application Ser. No. 10/639,573 filed on Aug. 12, 2003 now U.S. Pat. No. 6,910,819.

STATEMENT REGARDING FEDERALLY SPONSORED RESEARCH

Not Applicable

TECHNICAL FIELD

The present invention relates to a printer label media cartridge, and more particularly to a cartridge having a pivotally mounted label media spool.

DESCRIPTION OF THE BACKGROUND ART

There are a number of U.S. patents that disclose electronic apparatus for printing indicia on labels, some of these are restricted to hand held units and others that disclose tabletop units. Hand held label printers, such as disclosed in U.S. Pat. No. 6,113,293, and tabletop printers, such as disclosed in U.S. Pat. Nos. 6,266,075 and 5,078,523, include the same general combination of elements, a print head, means for feeding label media to be printed past the print head, a microprocessor, a read only memory programmed with appropriate instructions to operate the microprocessor, a random access memory, a keyboard with letter, number, and function keys for the entry of alphanumeric information and instructions concerning the indicia to be printed, and a visual display such as a light emitting diode (LED) or liquid crystal display (LCD) unit to assist the operator in using the printer. In a hand held printer, these components may all be enclosed in a single housing.

The label media comprises a series of labels that are attached to a carrier strip. The carrier strip is fed through the printer and legends, alphanumeric characters, and other indicia, are printed on the labels. The labels are then removed from the carrier and attached to the objects needing identification. As there are many types of label applications, there are many combinations of labels and carrier strips that provide labels of varying sizes, colors and formats.

A particular type of print head employs thermal transfer printing technology. Thermal transfer printing uses a heat generating print head to transfer a pigment, such as wax, carbon black, or the like, from a thermal transfer ribbon to a label media. By using digital technology, characters are formed by energizing a sequence of pixels on the print head which in turn melts the wax or other pigment on the ink ribbon transferring the image to the label media.

In a known thermal transfer printer such as a label printer, label media and ink ribbon are simultaneously fed past the print head by a platen roller in an overlay relationship between the print head and the platen roller. The platen roller is rotatably driven by a drive mechanism that may also rotatably drive ink ribbon take up and supply spools to maintain tension in the ink ribbon.

In a cartridge-based printing system, such as disclosed in U.S. Pat. No. 6,113,293, it is desirable to have a consistent label media path. In order to accomplish this, many cartridge-based printing systems have the label media path defined by a point tangent to the outside diameter of a roll of label media, such as a label media drive roller. This method, however, presents a problem as the label media is consumed. In particular, as the label media is consumed the diameter of the roll decreases and the beginning point of the label media path changes.

This problem is solved by pivotally mounting the label media, such that as the diameter of the label media decreases, the label media pivots to maintain the label media in contact with the label media drive roller. Unfortunately, as the label media is jostled or jarred, the label media can lose contact with the label media drive roller and retract into the cartridge. As a result, the end of the label media may be difficult to retrieve from the cartridge for use. Accordingly, a need exists for an improved printer cartridge that can carry label media that remains in contact with a label media drive roller even when jarred or jostled.

SUMMARY OF THE INVENTION

The present invention provides a printer cartridge suitable for use in a cartridge-based printer. The printer cartridge houses and dispenses a roll of label media, and includes a housing having a top wall and a bottom wall. A yoke pivotally mounted between the top and bottom walls for pivotable movement about a pivot axis includes a label media supply shaft for holding a roll of label media. The label media supply shaft has a longitudinal axis spaced from, and parallel to, the pivot axis. A label media drive roller is rotatably mounted between the top and bottom walls, and a biasing means biases the yoke toward the label media drive roller to maintain the roll of label media in contact with the label media drive roller. Ratchet teeth fixed relative to at least one of the housing and yoke engage structure of the other of the housing and the yoke to prevent the yoke from pivoting away from the label media drive roller.

A general objective of the present invention is to provide a cartridge that can house a roll of label media that maintains contact with a label media drive roller even when jostled and jarred. This objective is accomplished by providing a cartridge having a pivotally mounted yoke that maintains label media supported by the yoke in contact with a label media drive roller and ratchet teeth that prevent the yoke from pivoting away from the label media drive roller.

Another objective of the present invention is to prevent the yoke from twisting in the housing. This objective is accomplished by providing a rocker pad fixed relative to one of the yoke and the housing, and slidably engageable with a surface fixed relative to the other of the yoke and the housing to prevent said yoke from twisting.

The foregoing and other objectives and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

BRIEF DESCRIPTION OF THE DRAWINGS

FIG. 12 is a perspective view of the second media guide of FIG. 10;

FIG. 13 is a detailed perspective view of the pivot shaft interfacing with the second media guide of FIG. 10;

FIG. 14 is a detailed perspective view of the pivot shaft and torsion spring of the first media guide of FIG. 10;

FIG. 15 is a cross section of the first and second ratchet teeth of FIGS. 6 and 11; and FIG. 16 is an alternative embodiment of a hand held printer incorporating the present invention.

DETAILED DESCRIPTION OF THE PREFERRED EMBODIMENTS

Figure 1:
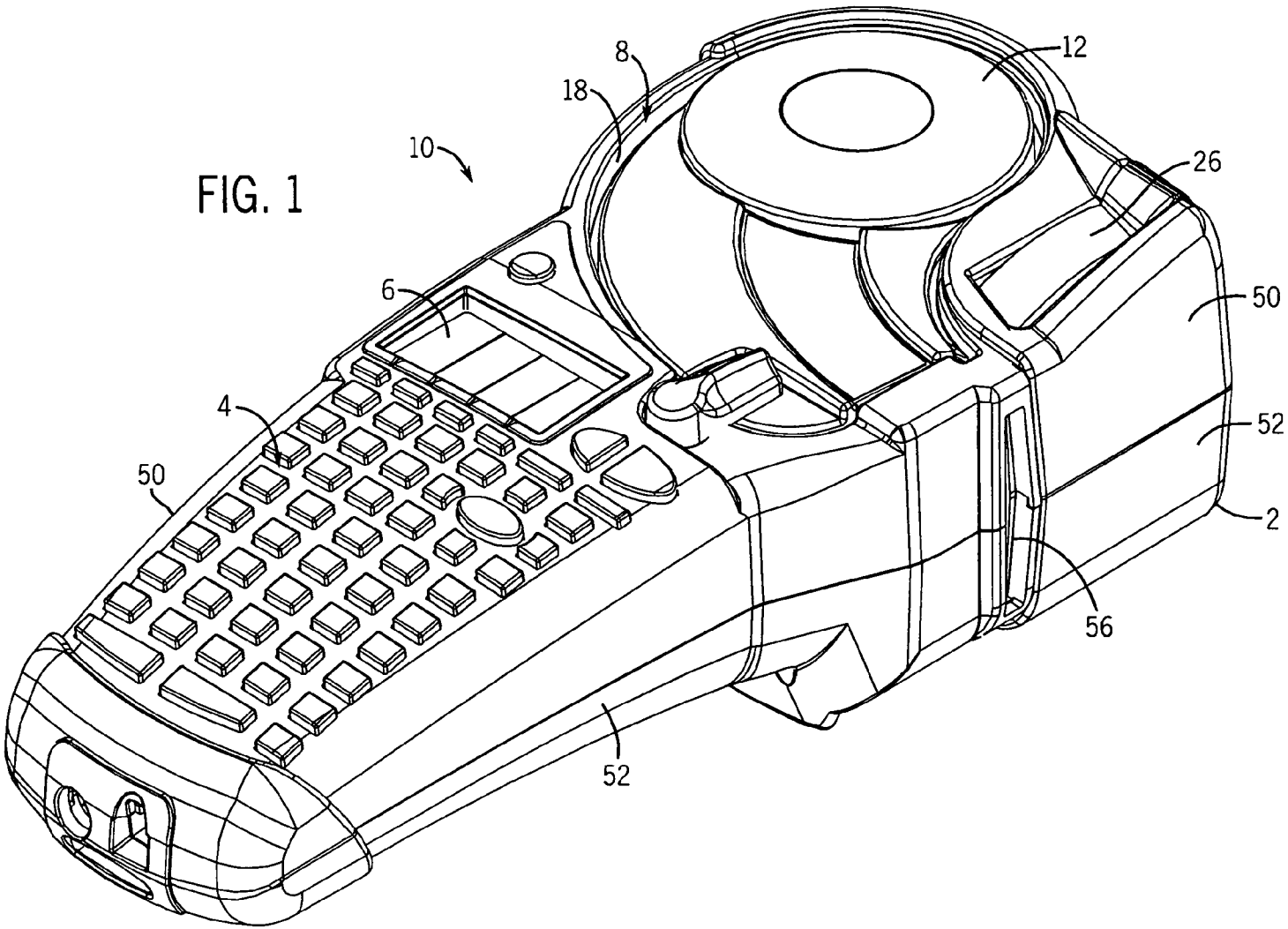
FIG. 1 is a perspective view of a hand held label printer incorporating the present invention.
Figure 2:
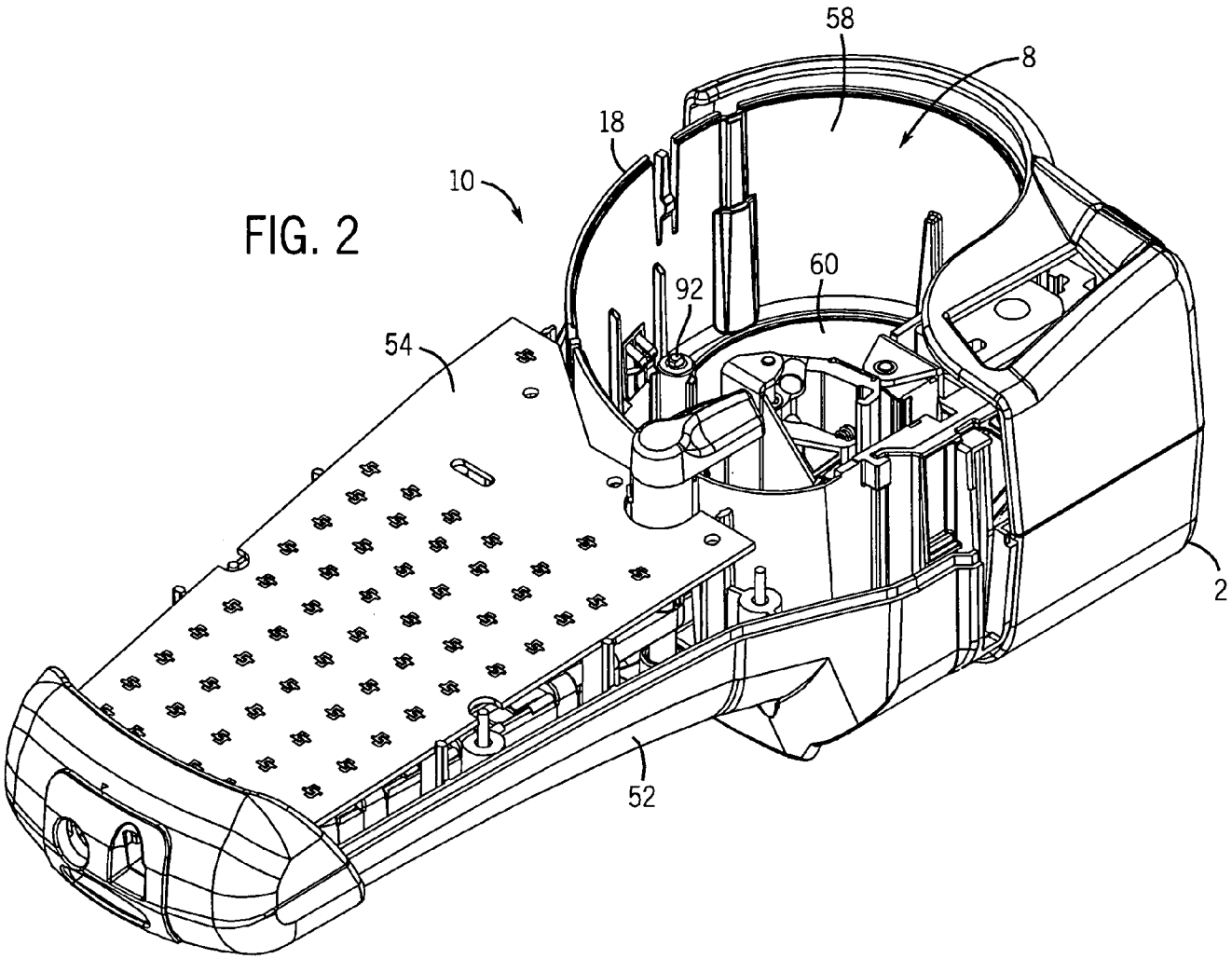
FIG. 2 is a perspective view of the printer of FIG. 1 with the cartridge and top portion, keyboard, and display removed.
Figure 3:
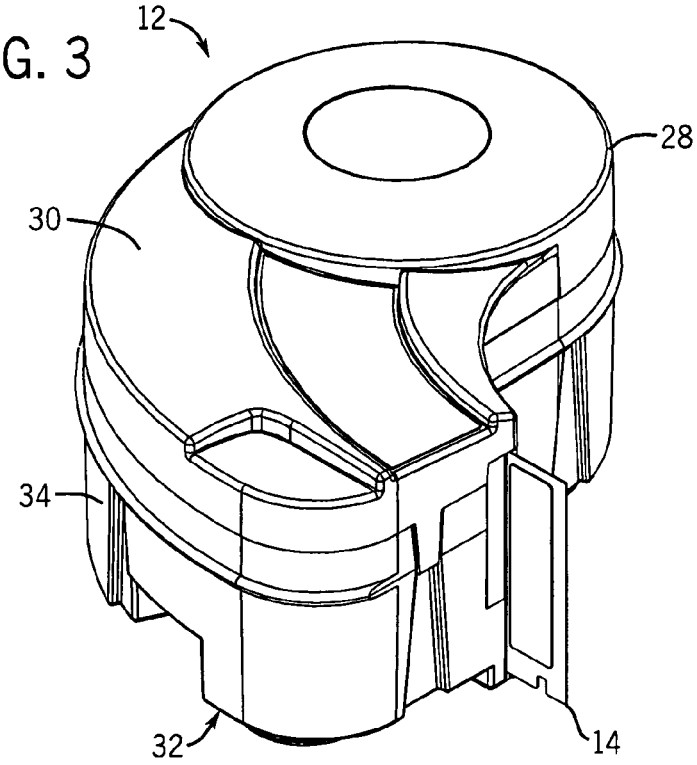
FIG. 3 is a top perspective view of the cartridge of FIG. 1.
Figure 4:
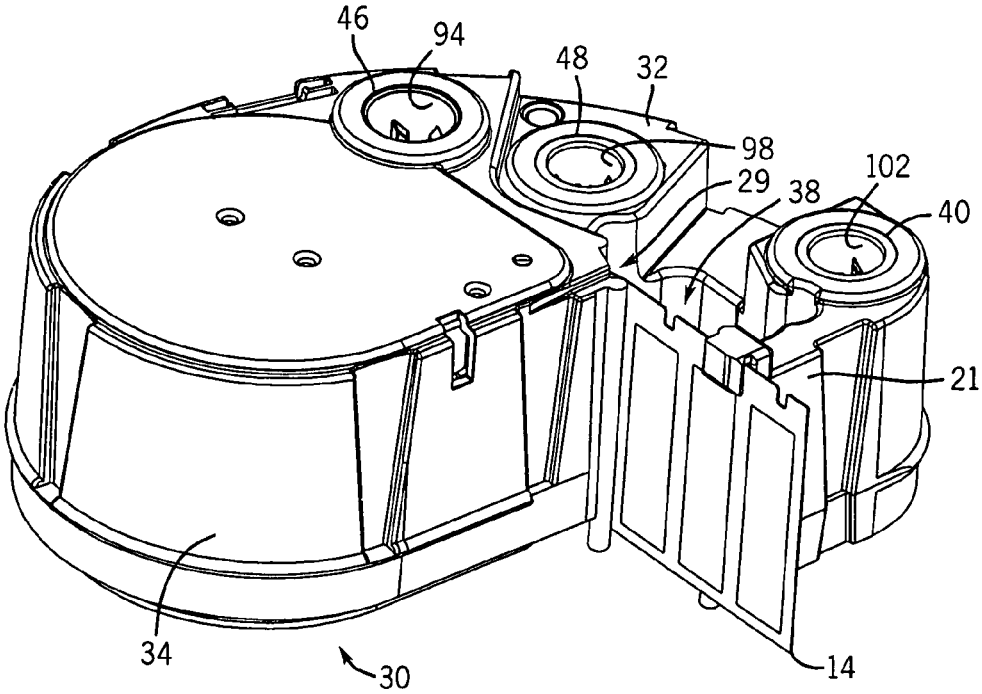
FIG. 4 is a bottom perspective view of the cartridge of FIG. 1.
Figure 5:
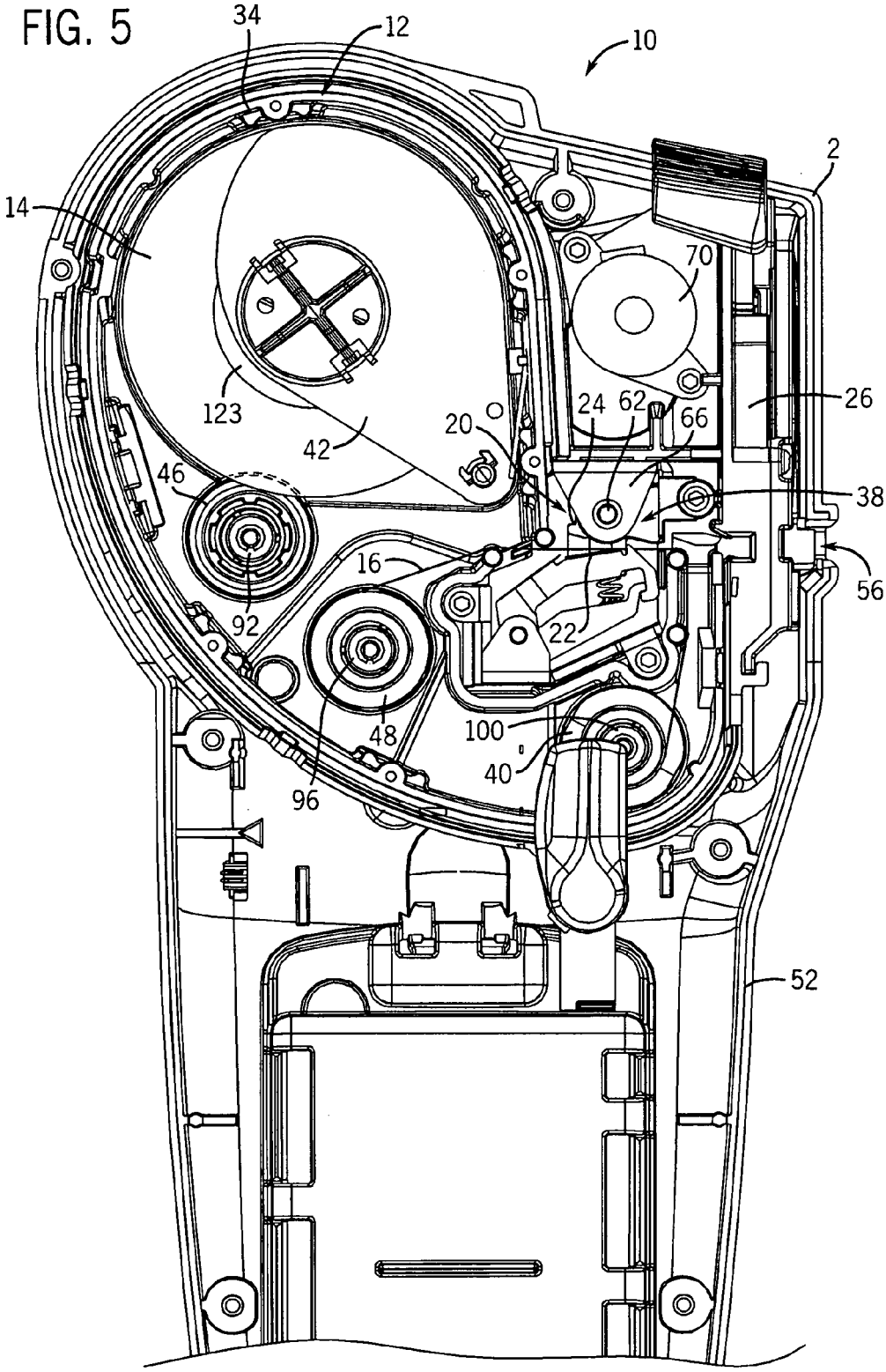
FIG. 5 is a top view of the cartridge of FIG. 1 received in the cartridge receptacle with the top wall of the cartridge removed.

Referring particularly to FIGS. 1–5, a hand held thermal printer 10 employing a preferred embodiment of the present invention includes a molded plastic housing 2 that supports a keyboard 4 on its front surface and a display 6 positioned above the keyboard 4. An opening 8 formed in the housing 2 above the display 6 receives a cartridge 12 containing label media 14 and an ink ribbon 16. The cartridge 12 is inserted through the opening 8 into a cartridge receptacle 18 housed in the printer housing 2. The label media 14 and ink ribbon 16 from the cartridge 12 are threaded through a printer mechanism assembly 20. The printer mechanism assembly 20 includes a print head 22 and a platen roller 24 for printing indicia on labels forming part of the label media 14. The printed labels pass through a cutter mechanism 26 which cuts the label media 14 to separate the printed labels from unprinted labels.

The label media 14 is known in the art, and generally comprises a carrier web which supports a series of adhesive labels. The size, width, color, and type of web material varies depending upon the particular print application. The label media 14 is dispensed from the cartridge 12, and urged along a web path as it is consumed by the printer 10.

Referring to FIGS. 3–9, the cartridge 12 includes a cartridge housing 28 having a top wall 30 and a bottom wall 32 joined by a periphery wall 34. The periphery wall 34 defines a label media and ink ribbon container for housing the label media and ink ribbon on spools. The label media 14 and ink ribbon 16 from the cartridge housing 28 pass out of the cartridge housing 28 through an exit slot 29 and into a printing area 38 external to the cartridge housing 28 for engagement with the platen roller 24 and print head 22. The used ink ribbon 16 reenters the cartridge housing 28, and is wound onto an ink ribbon take up spool 40 rotatably mounted in the cartridge housing 28.

The cartridge housing 28 disclosed herein is formed from a base 68 joined to a cover 70. The base 68 includes the cartridge housing bottom wall 32 and a lower portion 72 of the periphery wall 34. Ribs 74 spaced along the lower portion 72 of the periphery wall 34 include guide holes 76. Each guide hole 76 is formed in the free end of each rib 74 adjacent the free edge of the periphery wall lower portion 72 for receiving guide pins 78 extending from the cover 70. A pair of catches 80 is formed in an outwardly facing surface 82 of the periphery wall lower portion 72 for engaging latches 84 extending from the cover 70 to lock the base 68 and cover 70 together.

Drive shaft openings 86 formed in the bottom wall 32 receive drive shafts 92, 96, 100 therethrough for driving an ink ribbon supply spool 48, ink ribbon take up spool 40, and a label media drive roller 46 rotatably mounted in the cartridge housing 28. A circular recess 88 is formed around each drive shaft opening 86 in the inwardly facing surface 90 of the bottom wall 32. Each recess 88 receives a drag washer 95 for inducing drag during rotation of the ink ribbon supply spool 48, ink ribbon take up spool 40, and the label media drive roller 46. A smaller opening 99 formed through the bottom wall 32 adjacent the periphery wall lower portion 72 receives one end of a pivot shaft 103 forming part of the yoke 42 supporting the label media 14.

The cover 70 includes the cartridge housing top wall 30 and an upper portion 104 of the periphery wall 34. Cover ribs 106 spaced along the upper portion 104 of the periphery wall 34 are aligned with the base ribs 74 and include the guide pins 78 received in the guide holes 76 formed in the base ribs 74. Each guide pin 78 extends from each cover rib 106 adjacent the free edge of the periphery wall upper portion 104. The pair of latches 84 extend from the free edge of the periphery wall upper portion 104 for engaging the catches 80 formed in the base 68. An inwardly extending boss 108 formed in the cartridge housing top wall 30 receives the other end of the pivot shaft 103 forming part of the yoke 42.

First, second, and third cylindrical support columns 110, 112, 114 extend inwardly from the cartridge housing top wall 30. Each support column 110, 112, 114 rotatably supports either the ink ribbon supply spool 48, ink ribbon take up spool 40, or the label media drive roller 46. A coil spring 116 wrapped around each support column 110, 112, 114 urges the respective spool 48, 40 and label media drive roller 46 toward the cartridge housing bottom wall 32 and into engagement with a drag washer 95 received in the respective recess 88.

Unused ink ribbon 16 is housed in the cartridge housing 28 on the ink ribbon supply spool 48 and, once the ink ribbon 16 travels past the print head 22, is wound onto the ink ribbon take up spool 40. The ink ribbon supply and take up spools 48, 40 are both rotatably supported in the cartridge housing 28 on the second and third columns 112, 114, respectively. The ink ribbon take up and supply spools 40, 48 are selectively rotatably driven by an ink ribbon rewind drive shaft 100 and ink ribbon unwind drive shaft 96, respectively, which form part of a drive mechanism to maintain tension in the ink ribbon 16 in the forward and reverse feed directions.

The ink ribbon supply spool 48 is rotatably mounted on the second support column 112 between the cartridge housing top and bottom walls 30, 32, and has a roll of ink ribbon 16 wound thereon. In the forward feed direction, the ink ribbon 16 unwinds from the ink ribbon supply spool 48 and passes out of the cartridge 12 with the label media 14 through the printing area 38 between the print head 22 and platen roller 24. The print head 22 engages the ink ribbon 16 to transfer ink on the ink ribbon 16 onto the label media 14. Once the ink has been transferred, the ink ribbon 16 reenters the cartridge 12, and is wound onto the ink ribbon take up spool 40 supported between the top and bottom walls 30, 32.

The ink ribbon take up spool 40 is rotatably mounted on the third support column 114 between the cartridge housing top and bottom walls 30, 32, and, as described above, winds used ink ribbon 16 thereon in the forward feed direction. In the reverse feed direction, the ink ribbon 16 unwinds from the ink ribbon take up spool 40 and passes out of the cartridge 12 through the printing area 38 between the print head 22 and platen roller 24, and is wound onto the ink ribbon supply spool 48.

The label media drive roller 46 is rotatably mounted on the first support column 110 between the cartridge housing top and bottom walls 30, 32, and engages the label media 14 to define the beginning of the label media path. The beginning of the label media path is defined as the point of contact between the label media drive roller 46 and the label media 14 on the roll supported by the yoke 42. Preferably, the label media drive roller 46 is rubber coated, and in a forward feed direction provides a constant tension in the label media 14 between the label media drive roller 46 and the print head 22 and platen roller 24. In a reverse feed direction, a label media drive shaft 92 forming part of the drive mechanism drives the label media drive roller 46 to maintain tension in the label media 14 between the label media drive roller 46 and platen roller 24 and print head 22.

Each drag washer 95 is received in one of the circular recesses 88 formed around each drive shaft opening 86 of the cartridge housing 28, and frictionally engages one of the ink ribbon supply spool 48, take up spools 40, and label media drive roller 46 to induce a drag, or torque level, on the rotating spools 48, 40 and roller 46 in order to maintain tension in the label media 14 and ink ribbon 16. The coil springs 116 urge the spools 48, 40 and roller 46 against the drag washers 95 to provide the desired drag. The drag can be adjusted to a desired level using methods known in the art, such as texturing the washers, changing the spring constant of the coil springs, and the like, without departing from the scope of the invention. Of course, other methods for inducing drag can be used, such as introducing a drag in the spools and roller through the drive mechanism, frictionally engaging the spools and/or roller with the cartridge, a spring, or other structure, without departing from the scope of the invention.

The label media 14 engaging the label media drive roller 46 is housed in the cartridge housing 28 in the form of a roll rotatably mounted on the yoke 42. Advantageously, in the embodiment disclosed herein, the yoke 42 is pivotally mounted to maintain a consistent beginning of the label media path as the diameter of the roll of label media 14 decreases. The yoke 42 pivots so that the label media drive roller 46 engages the roll of label media 14 at a point of tangency to the outside diameter of the roll of label media 14 to provide a constant beginning of the label media path regardless of the roll diameter.

As shown in FIGS. 3, 5–14, the yoke 42 disclosed herein includes first and second label media guides 118, 120 joined by the pivot shaft 103 and label media supply shaft 122. Each end of the pivot shaft 103 is received in either the boss 108 formed in the cartridge housing top wall 30 or the opening 99 formed in the cartridge housing bottom wall 32 to pivotally mount the yoke 42 in the cartridge housing 28. The label media supply shaft 122 mounts the roll of label media 14, either alone, or on a core 123. Advantageously, the label media guides 118, 120 square the label media 14 relative to the cartridge exit slot 29 to prevent the label media 14 from jamming as it exits the cartridge housing 28.

Preferably, the first label media guide 118 is fixed to, or formed as an integral part of, one end of the pivot shaft 103 and label media supply shaft 122. The second label media guide 120 includes a pivot shaft opening 124 for slidably receiving the pivot shaft 103 and a label media supply shaft opening 126 for slidably receiving the label media supply shaft 122. Advantageously, the second label media guide 120 is slidable along the pivot shaft 103 and label media supply shaft 122 to accommodate rolls of label media 14 having different widths.

The second label media guide 120 disclosed herein is positionable at a plurality of preset positions for accommodating rolls of label media 14 of predetermined widths. Although providing a yoke 42 having preset positions defining different widths is preferred, a yoke having infinite adjustability for accommodating any label media width between a minimum and a maximum, such as by sizing the pivot shaft and/or label media supply shaft to frictionally engage the pivot shaft opening and/or label media supply shaft opening, respectively, can be provided without departing from the scope of the invention.

In the embodiment shown in FIGS. 3, 9–14, the preset positions are defined by notches 128 formed in the pivot shaft 103 and label media supply shaft 122. Latches 130 extending from the second label media guide 120 toward the first label media guide 118 engage the notches 128 to fix the second label media guide 120 relative to the first label media guide 118 at the desired preset position. Advantageously, this arrangement simplifies assembly of the cartridge 12 and minimizes the number of parts necessary for different widths of label media 14 because the same yoke 42 can be used to accommodate different label media widths.

The yoke 42 is pivotally biased by a torsion spring 44 toward the label media drive roller 46 rotatably mounted between the cartridge housing top and bottom walls 30, 32. The torsion spring 44 is wrapped around the pivot shaft 103, and has one end 132 engaging the first label media guide 118 and an opposing end 134 engaging the cartridge housing periphery wall 34 to urge the yoke 42, and thus the roll of label media 14, toward the label media drive roller 46. Advantageously, the torsion spring 44 maintains the label media drive roller 46 in contact with the roll of label media 14 as the diameter of the roll of label media 14 decreases during use. Although a torsion spring is disclosed, any biasing means for biasing the yoke toward the label media drive roller, such as leaf springs, coil springs, elastomeric members, resilient media guides, or arms, and the like, can be used without departing from the scope of the invention.

Figure 6:
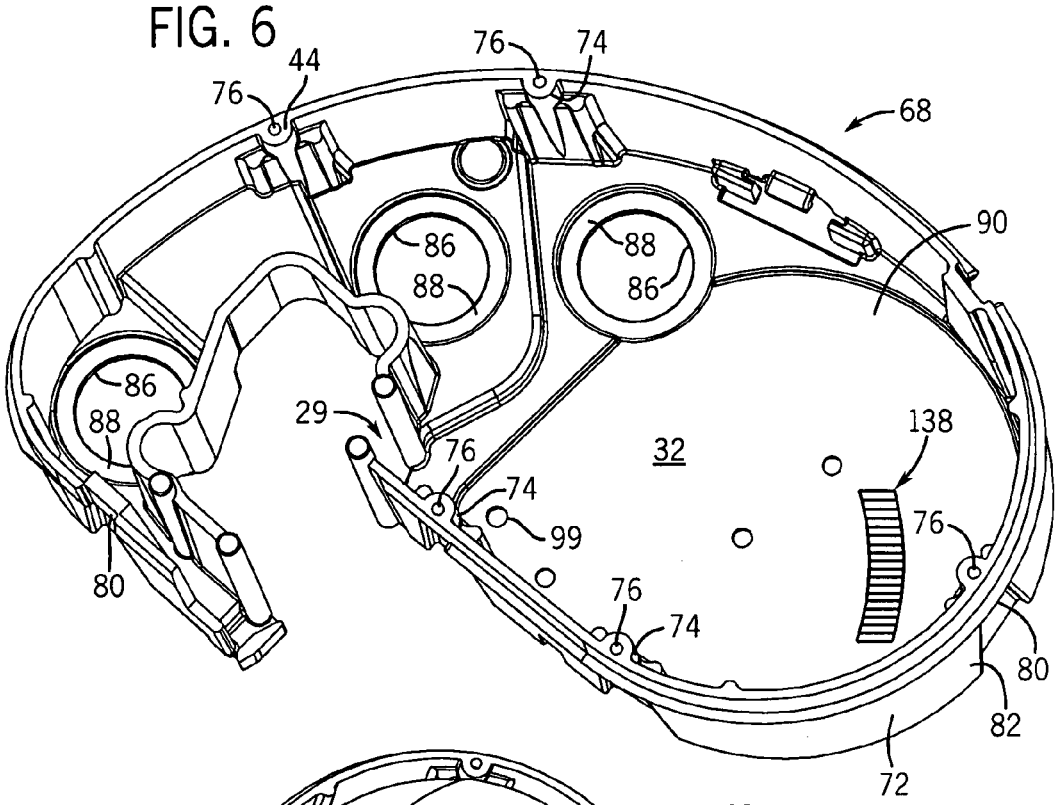
FIG. 6 is a top perspective view of the base of the cartridge housing of FIG. 3.
Figure 7:
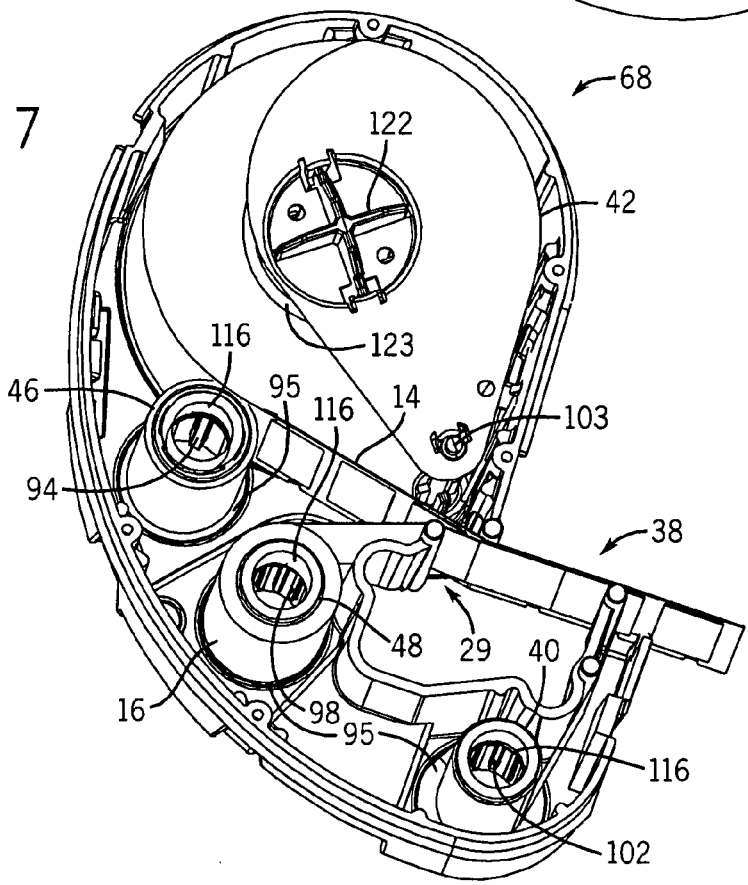
FIG. 7 is a top perspective view of the cartridge of FIG. 3 with the cover removed.
Figure 8:
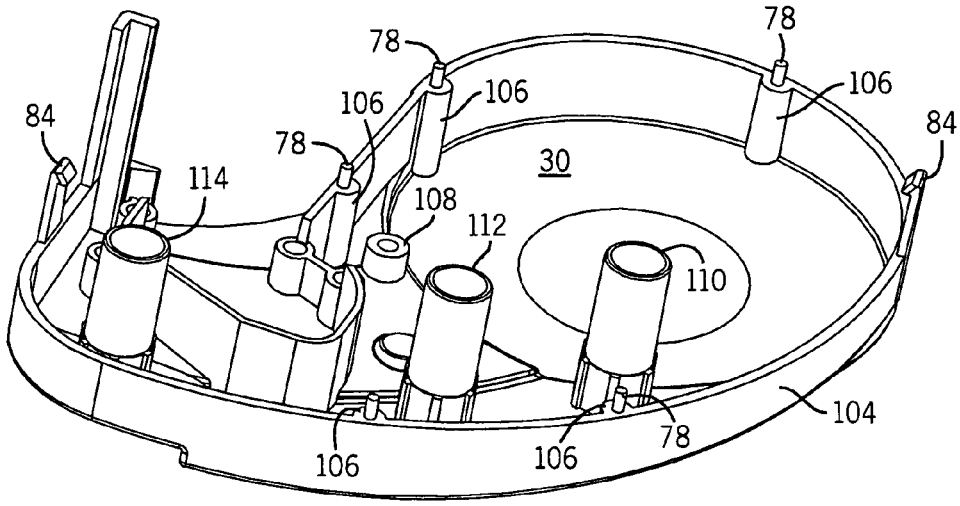
FIG. 8 is a bottom perspective view of the cover of the cartridge housing of FIG. 3.
Figure 9:
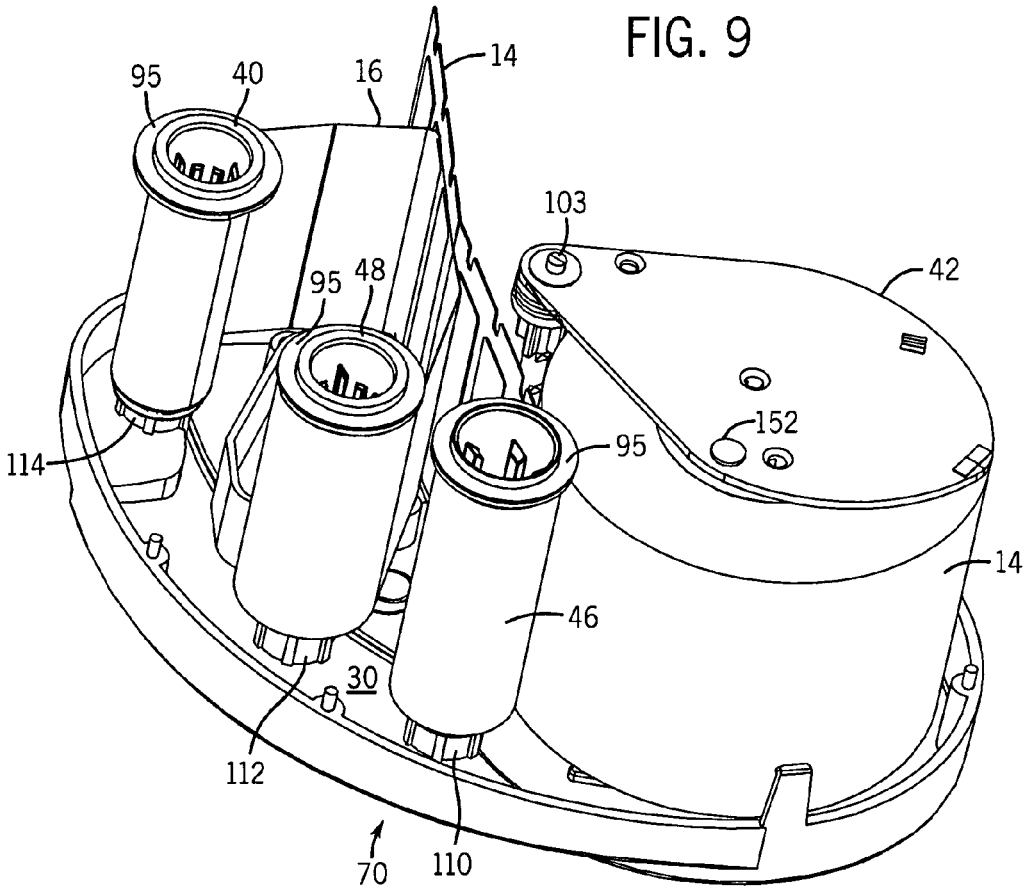
FIG. 9 is a bottom perspective view of the cartridge of FIG. 3 with the base removed.
Figure 10:
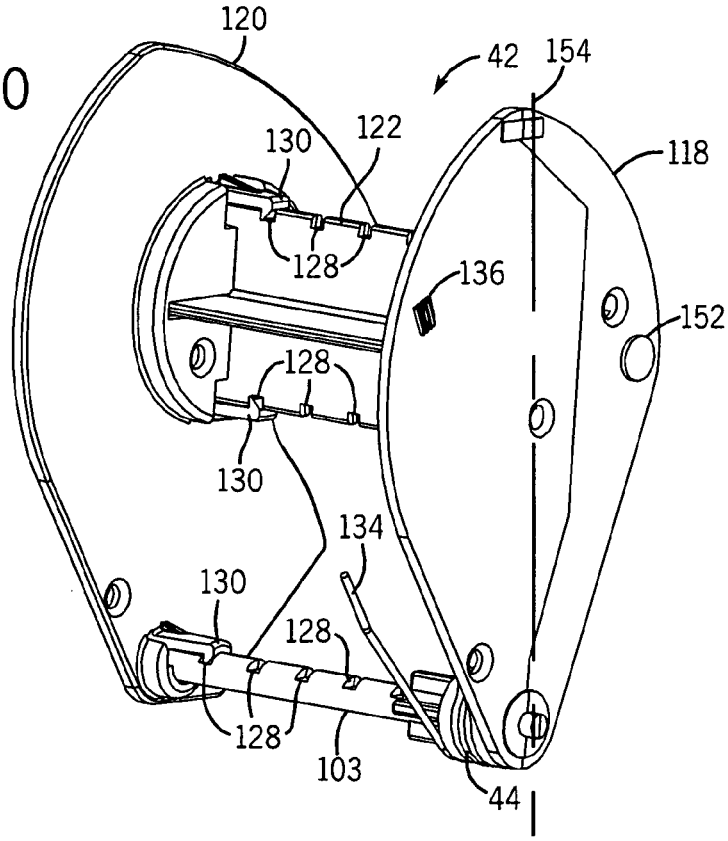
FIG. 10 is a perspective view of the yoke of FIG. 7.
Figure 11:
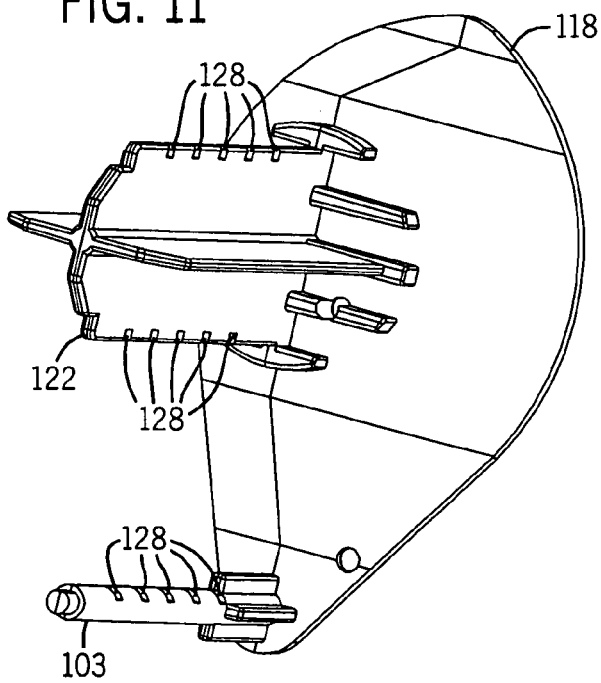
FIG. 11 is a perspective view of the first media guide of FIG. 10.

Referring now to FIGS. 3, 5, 6, 9, 10, and 15, the yoke 42 is prevented from pivoting away from the label media drive roller 46 by first and second ratchet teeth 136, 138 to prevent the label media 14 from being inadvertently retracted into the cartridge housing 28 in the event of the cartridge 12 being vibrated, jostled, or jarred. As shown in FIGS. 6 and 11, a plurality of the first ratchet teeth 136 extend from the first label media guide 118 of the yoke 42 toward the cartridge housing bottom wall 32. The first ratchet teeth 136 extending from yoke 42 engage a plurality of the second ratchet teeth 138 extending from the bottom wall 32 to prevent the yoke 42 from pivoting away from the label media drive roller 46.

Preferably, the ratchet teeth 136, 138 are shaped to allow the yoke 42 to pivot toward the label media drive roller 46 as the label media 14 is consumed, while preventing the yoke 42 from pivoting away from the label media drive roller 46 when the cartridge 12 is vibrated, jostled, or jarred. Each second ratchet tooth 138 having substantially equal widths extends radially from the pivot shaft 103 to form an arcuate row of the second ratchet teeth 138, and has a gradually sloped first side 142. Advantageously, the gradually sloped first side 142 allows one of the first ratchet teeth 136 to ride up and over the second ratchet tooth end 144 as the first label media guide 118 flexes and the yoke 42 pivots toward the label media drive roller 46. A second oppositely facing side 146 of each second ratchet tooth 138 is steeper than the first side 142 to prevent the first ratchet tooth 136 from riding back up and over the second ratchet tooth end 144 and allow the yoke 42 to pivot away from the label media drive roller 46. The first ratchet teeth 136 can have a similar, complementary shape as the second ratchet teeth 138, such as shown in FIG. 15, or have steep sides, without departing from the scope of the invention.

Although the first ratchet teeth 136 are shown fixed relative to the yoke 42 and the second ratchet teeth 138 are shown fixed relative to the cartridge housing bottom wall 32, the first ratchet teeth 136 can be fixed relative to one of the yoke 42 and housing 28 and the second ratchet teeth 138 can be fixed relative to the other of the yoke 42 and housing 28 without departing from the scope of the invention. Moreover, although a plurality of ratchet teeth 136, 138 extending from each of the yoke 42 and housing 28 is preferred, only one tooth extending from one of the yoke 42 and housing 28 engageable with one or more teeth extending from the other of the yoke 42 and housing 28 is sufficient to prevent the yoke 42 from pivoting away from the label media drive roller 46 in certain applications, and thus fall within the scope of the invention.

A rocker pad 152 extending from the first label media guide 118 slidably engages the cartridge housing bottom wall 32 to support the second label media 14 held by the yoke 42 and prevent the first label media guide 118 from twisting under the weight of the label media 14. The rocker pad 152 is spaced from the first ratchet teeth 136 across a longitudinal axis 154 extending radially from the pivot shaft 103 the length of yoke 42 to prevent the first label media guide 118 from twisting, and thus disengaging the first and second ratchet teeth 136, 138 from each other. Of course, the rocker pad 152 can extend from the housing 28 and slidably engage the yoke 42 to support the label media 14 and prevent the first label media guide 118 from twisting without departing from the scope of the invention.

Referring back to FIGS. 1–5, the cartridge 12 is received in the cartridge receptacle 18 housed in the printer housing 2. The printer housing 2 is, preferably, formed from at least two portions 50, 52, and houses printer components, such as the cartridge receptacle 18, the keyboard 4, display 6, the cutter mechanism 26, a printed circuit board 54 having printer circuitry, and the like. The opening 8 formed in the housing top portion 50 provides access to the cartridge receptacle 18 for insertion of the cartridge 12 into the cartridge receptacle 18. A slot 56 formed in the housing 2 adjacent the cutter mechanism 26 provides an exit for label media 14 which has passed through the cutter mechanism 26.

Referring to FIGS. 2 and 5–9, the cartridge receptacle 18 has a periphery wall 58 generally shaped to conform with the cartridge periphery wall 34, and a bottom wall 60 that supports the cartridge 12 therein. The cartridge receptacle periphery wall 58 surrounds the printer mechanism assembly 20 which is fixed in the printer housing 2 relative to the cartridge receptacle 18.

The printer mechanism assembly 20 fixed relative to the cartridge receptacle 18 in the printer housing 2 includes the pivotable print head 22 and stationary platen roller 24. The print head 22 cooperates with the ink ribbon 16 and the label media 14 such that the print head 22 can print characters or symbols on the label media 14. This is described in greater detail in U.S. Pat. No. 5,078,523 which is incorporated herein by reference. The platen roller 24 also forms part of the drive mechanism.

The drive mechanism drives the label media 14 and ink ribbon 16 past the print head 22, and includes the platen roller drive shaft 62, label media drive shaft 92, ink ribbon rewind drive shaft 100, and ink ribbon unwind drive shaft 96. The drive mechanism selectively drives the rollers 24, 46 and spools 40, 48 to drive and tension the label media 14 and ink ribbon 16 in the forward and reverse feed directions. Preferably, the platen roller 24, label media drive roller 46, ink ribbon supply spool 48, and ink ribbon take up spool 40 are all rotatably driven by a dual feed direction drive mechanism mounted to the bottom of the cartridge receptacle 18, such as disclosed in a copending U.S. patent application Ser. No. 10/639,548 filed on Aug. 12, 2003. Although the drive mechanism disclosed in the copending patent application is preferred, any drive mechanism known in the art that can feed the label media and ink ribbon in one or more feed directions can be used without departing from the scope of the invention.

The label media 14 and ink ribbon 16 passing through the printing area 38 are advanced past the print head 22 in the forward feed direction and reverse feed direction by the platen roller 24 which maintains the ink ribbon 16 and label media 14 in close cooperation with the print head 22. The platen roller 24 is mounted on a platen roller drive shaft 62 which is rotatably mounted in the cartridge receptacle 18 by a bracket 66. The print head 22 is pivotally mounted relative to the platen roller 24 in the cartridge receptacle 18 to provide space between the print head 22 and platen roller 24 when threading the label media 14 and ink ribbon 16 therebetween.

As the label media 14 and ink ribbon 16 are driven in the forward and reverse feed directions by the platen roller 24, tension is maintained in the ink ribbon 16 and label media 14 by the label media drive shaft 92, ink ribbon rewind drive shaft 100, and ink ribbon unwind drive shaft 96. The label media drive shaft 92, ink ribbon rewind drive shaft 100, and ink ribbon unwind drive shaft 96 are each received through one of the drive shaft openings 86 formed in the cartridge housing bottom wall 32 and into one of the first, second, and third support columns 110, 112, 114. The drive shafts 92, 96, 100 extend through the support columns 110, 112, 114, and engage inner surfaces 94, 98, 102 of, and rotatably drive, the label media drive roller 46, ink ribbon supply spool 48, and ink ribbon take up spool 40, respectively.

Referring to FIGS. 1–15, in use, the cartridge 12 is inserted into the cartridge receptacle 18 with the label media drive shaft 92 received in the label media drive roller 46, the ink ribbon unwind drive shaft 96 received in the ink ribbon supply spool 48, and the ink ribbon rewind drive shaft 100 received in the ink ribbon take up spool 40 to properly position the cartridge 12 in the cartridge receptacle 18 and thread the label media 14 and ink ribbon 16 between the platen roller 24 and print head 22. The print head 22 is then urged toward the platen roller 24 to sandwich the label media 14 and ink ribbon 16 therebetween.

Once the cartridge 12 is locked in place, the printer 10 is ready to produce printed labels. When printing on the labels, the label media 14 and ink ribbon 16 are fed past the platen roller 24 and print head 22 by the platen roller 24 in the forward feed direction by driving the platen roller 24 in a first direction of rotation. The ink ribbon take up spool 40 is rotatably driven in the first direction of rotation to take up the used ink ribbon 16 fed past the print head 22 and maintain tension in the ink ribbon 16. The label media drive roller 46 and ink ribbon supply spool 48 are not rotatably driven. The drag induced on the label media drive roller 46 and ink ribbon supply spool 48 by the drag washers 95 creates a tension in the label media 14 and ink ribbon 16 to prevent jams.

When a desired character is input by an operator or other means, the printer circuitry of the printer 10 energizes pixels on the print head 22 as the label media 14 and ink ribbon 16 advance past the print head 22. The head pixels are variously energized to imprint the character on the label media 14. This is described in greater detail in U.S. Pat. No. 5,078,523 which has been incorporated herein by reference.

As label media 14 is unwound from the roll of label media 14, the diameter of the roll of label media 14 is reduced. Advantageously, the yoke 42 pivots about the pivot axis defined by the pivot shaft 103 in the cartridge housing 28 to maintain the label media in contact with the label media drive roller 46 and define the consistent beginning of the label media path from the roll of label media 14. As the yoke 42 pivots, the first and second ratchet teeth 136, 138 move relative to each other to index the yoke 42 closer to the label media drive roller 46 as the diameter of the roll of label media 14 decreases. Advantageously, the first label media guide 118 flexes to allow the first ratchet teeth 136 to slide over the second ratchet teeth 138 and index the yoke 42. Advantageously, at each index point, the engaged ratchet teeth 136, 138 prevent the yoke 42 from pivoting away from the label media drive roller 46 due to inadvertent vibration, jarring, or jostling.

When a label has been printed, the platen roller 24 continues to drive the label media 14 and ink ribbon 16 in the forward feed direction to advance the label for removal by the user, such as by cutting the label media 14 using the cutter mechanism 26. Once the portion of the label media 14 containing the printed label is removed, the remaining label media 14 and ink ribbon 16 are fed in the reverse feed direction by the platen roller 24 to position the next available label in position for printing without wasting the label media 14 and ink ribbon 16.

The label media 14 and ink ribbon 16 are fed past the platen roller 24 and print head 22 in the reverse feed direction by driving the platen roller 24, label media drive roller 46, and ink ribbon supply spool 48 in a second direction of rotation. The platen roller 24 drives the label media 14 and ink ribbon 16 past the print head 22 while the ink ribbon 16 is wound onto the ink ribbon supply spool 48 and the label media 14 is urged onto the roll by the label media drive roller 46. The pixels on the print head 22, however, remain deenergized to avoid printing on the label as it is being repositioned for printing. The ink ribbon take up spool 40 is not rotatably driven, and the drag induced on the ink ribbon take up spool 40 by the drag washer 95 creates a tension in the ink ribbon 16 to prevent jams.

In an alternate embodiment shown in FIG. 16, a plurality of the first ratchet teeth 136 are formed on an edge of the first label media guide 120. A resilient pawl 156 fixed to, and extending from, the housing 28 engages at least one of the first ratchet teeth 136 to prevent the yoke 42 from pivoting away from the label media drive roller 46. Advantageously, the resilient pawl 156 can also bias the yoke 42 toward the label media drive roller 46. Of course, the resilient pawl 156 can be fixed to, and extend from, the yoke 42 to engage the first ratchet teeth 136 fixed relative to the housing 28 without departing from the scope of the invention.

While there has been shown and described what is at present considered the preferred embodiment of the invention, it will be obvious to those skilled in the art that various changes and modifications can be made therein without departing from the scope of the invention defined by the appended claims. For example, the cartridge disclosed herein is for use with a roll of label media, however, any type of media in a roll and useable in a printer can be used without departing from the scope of the invention.

We claim:

1. A printer cartridge for housing a roll of label media and dispensing the label media from the cartridge, said cartridge comprising:

a housing having a top wall and a bottom wall;

a yoke pivotally mounted between said top and bottom walls for pivotal movement about a pivot axis, and including a label media supply shaft for holding a roll of label media, said label media supply shaft having a longitudinal axis spaced from and parallel to said pivot axis;

a label media drive roller rotatably mounted between said top and bottom walls and engageable with the roll of label media;

at least one first ratchet tooth fixed relative to one of said yoke and said housing to prevent said yoke from pivoting away from said label media drive roller and a biasing means biases at least one said first ratchet tooth toward the said yoke and said housing to engage said at least one first ratchet tooth with structure fixed relative to said other of said yoke and said housing to prevent said yoke from pivoting away from said label media drive roller.

2. The printer cartridge as in claim 1, in which said yoke includes a media guide supporting one end of said label media supply shaft adjacent one of said top and bottom walls of said housing, and said at least one first ratchet tooth extends from said media guide toward said one of said top and bottom walls of said housing.

3. The printer cartridge as in claim 2, in which a second ratchet tooth extending from said one of said top and bottom walls engages said at least one first ratchet tooth to prevent said yoke from pivoting away from said label media drive roller.

4. The printer cartridge as in claim 1, in which a resilient lever extending from the other of said yoke and said housing engages said at least one first ratchet tooth to prevent said yoke from pivoting away from said label media drive roller.

5. The printer cartridge as in claim 1, in which a plurality of first ratchet teeth are fixed relative to one of said yoke and said housing to prevent said yoke from pivoting away from said label media drive roller.

6. The printer cartridge as in claim 1, in which said biasing means is a torsion spring wrapped around said pivot axis, said torsion spring biasing said yoke toward said label media drive roller to maintain the roll of label media in contact with said label media drive roller, and said torsion spring also biasing said at least one first tooth toward structure fixed relative to said housing to prevent said yoke from pivoting away from said label media drive roller.

7. The printer cartridge as in claim 1, including a rocker pad spaced fixed relative to one of said yoke and said housing, and being slidably engageable with a surface fixed relative to the other of said yoke and said housing to prevent said yoke from twisting.

8. The printer cartridge as in claim 1, including a roll of label media supported by said label media supply shaft.

9. A printer cartridge for housing a roll of label media and dispensing the label media from the cartridge, said cartridge comprising:

a housing having a top wall and a bottom wall;

a yoke pivotally mounted between said top and bottom walls for pivotal movement about a pivot axis, and including a label media supply shaft for holding a roll of label media, said label media supply shaft having a longitudinal axis spaced from and parallel to said pivot axis;

a label media drive roller rotatably mounted between said top and bottom walls and engageable with the roll of label media;

at least one first ratchet tooth fixed relative to one of said yoke and said housing to prevent said yoke from pointing away from said label media drive roller;

a rocker pad fixed relative to one of said yoke and said housing, and slidably engageable with a surface fixed relative to the other of said yoke and said housing to prevent said yoke from twisting and a biasing means biases at least one said first ratchet tooth toward the said yoke and said housing to engage said at least one first ratchet tooth with structure fixed relative to said other of said yoke and said housing to prevent said yoke from pivoting away from said label media drive roller.

10. The printer cartridge as in claim 9, in which said yoke includes a media guide supporting one end of said label media supply shaft adjacent one of said top and bottom walls of said housing, and said at least one first ratchet tooth extends from said media guide toward said one of said top and bottom walls of said housing.

11. The printer cartridge as in claim 10, in which a second ratchet tooth extending from said one of said top and bottom walls engages said at least one first ratchet tooth to prevent said yoke from pivoting away from said label media drive roller.

12. The printer cartridge as in claim 9, in which a resilient lever extending from the other of said yoke and said housing engages said at least one first ratchet tooth to prevent said yoke from pivoting away from said label media drive roller.

13. The printer cartridge as in claim 9, in which a plurality of first ratchet teeth are fixed relative to one of said yoke and said housing to prevent said yoke from pivoting away from said label media drive roller.

14. The printer cartridge as in claim 10, in which said biasing means is a torsion spring wrapped around said pivot axis, said torsion spring biasing said yoke toward said label media drive roller to maintain the roll of label media in contact with said label media drive roller, and said torsion spring also biasing said at least one first tooth toward structure fixed relative to said housing to prevent said yoke from pivoting away from said label media drive roller.

15. The printer cartridge as in claim 9, including a roll of label media supported by said label media supply shaft.

* * * * *

UNITED STATES PATENT AND TRADEMARK OFFICE

CERTIFICATE OF CORRECTION

PATENT NO. : 7,201,522 B2
APPLICATION NO. : 11/020333
DATED : April 10, 2007
INVENTOR(S) : Bandholz et al.

It is certified that error appears in the above-identified patent and that said Letters Patent is hereby corrected as shown below:

Column 10, line 31 “toward the said yoke” should be changed to -- toward said other of said yoke --

Column 11, line 18 “pointing” should be changed to -- pivoting --

Column 11, lines 23-24 “toward the said yoke” should be changed to -- toward said other of said yoke --

Signed and Sealed this

Tenth Day of July, 2007

JON W. DUDAS
*Director of the United States Patent and Trademark Office*